United States Patent [19]

Fresnel

[11] Patent Number: 4,979,314

[45] Date of Patent: Dec. 25, 1990

[54] METHOD OF CONTROLLING THE TEMPERATURE IN A TUNNEL WHICH IS OPEN AT BOTH ENDS, AND APPARATUS FOR IMPLEMENTING THE METHOD

[75] Inventor: Jacques Fresnel, Paris, France

[73] Assignee: Sleever International Company, France

[21] Appl. No.: 378,420

[22] Filed: Jul. 11, 1989

[30] Foreign Application Priority Data

Jul. 13, 1988 [FR] France ..... 88 09570

[51] Int. Cl.[5] ..... F26B 7/100

[52] U.S. Cl. ..... 34/21; 34/54; 34/104

[58] Field of Search ..... 34/104, 105, 107, 43, 34/54, 21

[56] References Cited

FOREIGN PATENT DOCUMENTS 0058652 2/1982 European Pat. Off. .
0058602 8/1982 European Pat. Off. .
2233234 6/1973 France .
7530896 2/1982 France .
8515717 5/1988 France .
1062349 3/1967 United Kingdom .

*Primary Examiner*—Henry A. Bennet
*Attorney, Agent, or Firm*—Mason, Kolehmainen, Rathburn & Wyss

[57] ABSTRACT

The invention relates to controlling the temperature in a tunnel (1) including heating or cooling means (4) disposed along its side walls and means (5) for blowing in a gaseous fluid at a given temperature along a direction essentially perpendicular to the direction which objects are conveyed along the tunnel. The temperature is detected in the zone of the tunnel into which the gaseous fluid is blown, and the blower means (5) are displaced in a direction essentially parallel to the direction in which the objects (3) are conveyed by means of a servo-control system for ensuring that the blower means move automatically when the sensed temperature differs from a predetermined temperature, thereby permanently providing a constant temperature environment for the, or each, object in said zone of the tunnel. The invention is particularly applicable to shrinking heat shrink sleeves onto flasks for decorative and/or protective purposes, and also to cooling down receptacles made of glass.

20 Claims, 2 Drawing Sheets

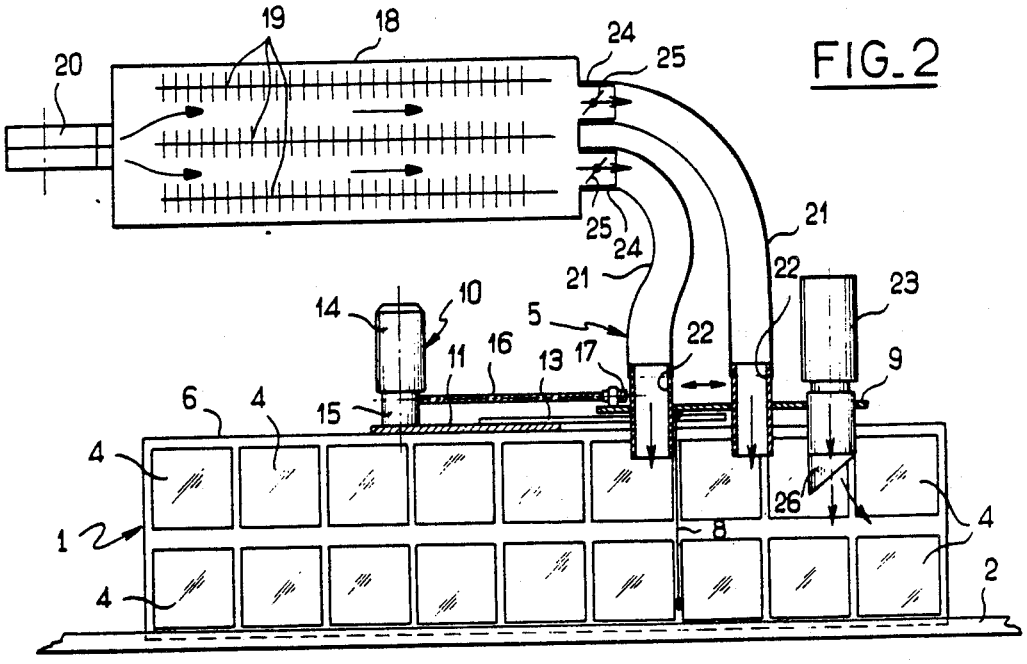
FIG_2
FIG_3
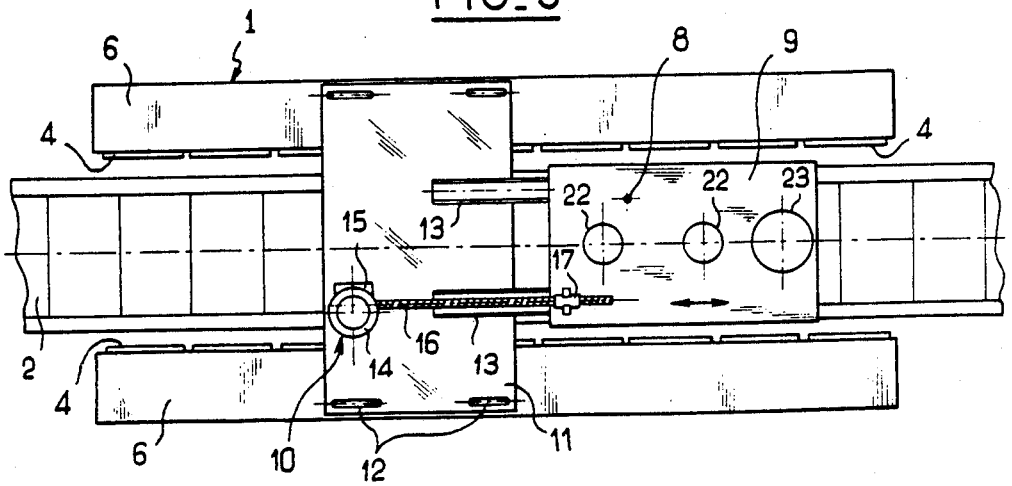

METHOD OF CONTROLLING THE TEMPERATURE IN A TUNNEL WHICH IS OPEN AT BOTH ENDS, AND APPARATUS FOR IMPLEMENTING THE METHOD

The present invention relates to the heat treatment of objects passing along a tunnel which is open at both ends, and more particularly to controlling the temperature inside such tunnels.

The tunnels in question include object-conveyor means, heating or cooling means disposed along their side walls, and means for blowing a gaseous fluid at a given temperature along a direction which is essentially perpendicular to the direction along which the objects are conveyed.

The gaseous fluid (e.g. air) blown into such a tunnel may be used either for cooling or for heating the objects being conveyed, and the term "tunnel" is used with this wide meaning in the context of the present invention, even though the specific example relates to heating only.

Numerous applications may be concerned, and for cooling mention may be made of glass bottles which need cooling in controlled manner after tempering, particularly for strain-relieving purposes, and for heating, mention may be made of applying a length of heat-shrink sleeve or covering to an object, where the sleeve is placed loosely over the object to be decorated and/or protected, and is then heated to a temperature higher than the softening temperature of the film from which it is made so as to cause it to shrink onto said object.

The invention is particularly applicable to such heat-shrink applications, but it will be understood that this is merely one particular application of the temperature control method of the invention and that the invention is not limited in any way to this particular application.

It is now common practice to use certain films of plastic material, optionally to print on them, and then make them up into the form of a tube by bonding together two edges of a strip so as to be able to decorate and/or protect an object, and more particularly for the purpose of packaging a product.

Thus, receptacles such as bottles, spray cans, aerosols, flasks, jam jars, and other packaging objects are being provided more and more frequently with a protective sleeve or tube, or indeed a tamper-proofing ring, made of heat shrink plastic material. The sleeve is placed around the receptacle, and after external heating to a temperature greater than its softening temperature, it is required to fit around the outline of the receptacle with a minimum amount of distortion. Such shrinkable tubes are made using plastic films (generally made of polyvinyl chloride) to which memory is imparted during manufacture, and they are generally made to be shrinkable. These films are generally stretched essentially in the circumferential direction of the objects that they cover so as to acquire shape memory in the stretching direction which may allow for 70% shrinking (in fact commonly used films possess between 50% and 60% shrinkage memory); the memory in the longitudinal direction, i.e. the direction corresponding to the height of covering is normally only about 3% to 7%.

In order to impart memory to a film of plastic material (made of polyvinyl chloride, polystyrene, or polypropylene, for example), the film must be heated to a very accurate temperature which is generally selected to be less than the vitreous transition point of the plastic material, and while at that temperature it is subjected to transverse and/or longitudinal traction. Heating softens the film, thereby enabling its molecules to creep and thus increase the initial dimensions of the film, while simultaneously reducing the initial thickness of said film.

Such films which are normally printed and/or decorated to serve as labels for the objects that they cover are said to be "mono-oriented" or to be "mainly mono-oriented". If transparent films of polyvinyl chloride are used, printing may be performed on the inside, thereby providing a shiny effect while simultaneously protecting the printing against any danger of it being rubbed off. In addition to the decoration aspect, there may also be a question of providing protection, not only to ensure that the contents is tamperproof, but also to provide a barrier, e.g. for reducing loss of perfume with polypropylene wrapping or loss of carbon dioxide gas for carbonated drinks in polypropylene terephthalate packages.

This application has become very popular for preparing goods for sale to the general public since it provides a wide range of decorative options, including possible reproduction of photographs, while using objects with a wide variety of outlines.

Although the techniques of manufacturing heat shrink films, of printing on them, of shaping them into tubes, and of placing the resulting sleeves around objects or packages are now substantially mastered, the same is not true of the operation of causing said sleeves to shrink, particularly when the object or package has an irregular section which is triangular, square, or rectangular in shape having faces with convex and/or concave zones.

It is essential that shrinking occurs uniformly around the object or package, i.e. without wrinkling, curling, or puncturing the covering, and without deforming the printing on the film, which printing, in addition to its eye-catching appearance may also have direct utility (e.g. bar codes for machine reading and/or for instructions).

The difficulties encountered in mastering the shrinking operation are largely due to problems that are essentially thermal: each oriented plastic film has its own softening point and its own temperature at which its crystalline and amorphous zones are rearranged, depending on its nature and its formulation. It is essential to know the rearrangement temperature when attempting to shrink a film since the film will restore its memory in full so long as its temperature remains below its rearrangement temperature, i.e. the temperature chosen for stretching, and its memory is lost, at least in part, if this temperature is exceeded.

It thus appears essential to be able to control the temperature in the tunnel used with a very high degree of accuracy.

More particularly, in the context of this application, it is highly advantageous to be able to select a shrinkage temperature which is as low as possible so that the printing is affected as little as possible by the longitudinal shrinking action.

Highly accentuated mono-orientation (50% to 60% in the transverse direction and only 5% to 7% in the longitudinal direction) gives rise to instability in the film which is greater in the transverse direction, with shrinking in the transverse direction beginning at a lower temperature than shrinking in the longitudinal direction (20% to 25% of shrinkage in the transverse direction generally occurs prior to any shrinking taking place in the longitudinal direction). This makes it impossible to forecast accurately the changes in position of a given zone in the printing, and as a result the printing cannot be accurately amplified in both directions on printing in order to compensate for film shrinkage in such a manner as to obtain a final result in which the printing is undistorted.

Other difficulties in obtaining a good coating without defects or deformation on the objects to be coated stems from the fact that the sleeve is in contact with the object during the softening stage prior to shrinkage per se, and this contact inevitably causes heat to be absorbed until thermal equilibrium between the film and the wall of the object has been reached. This is inevitable in practice given that prior to being put into place, the sleeve is in the form of a length of flat covering which needs opening prior to placing around the object to be coated. There always remains a trace of the fold. The open section of the sleeve is thus never a circle, but is rather an ellipse which is very much flattened at its ends. As a result, this section does not correspond to the section of the object, particularly if the section of the object is triangular or quadrangular. The heat absorbed by the film for shrinkage purposes is thus dispersed to the surface of the object in those zones where the film and the objects come into contact. Unfortunately, the area of these contact zones tends to increase as the film softens and tends to collapse against the object to be coated. In addition, the zone of film in the vicinity of the fold never makes contact with the object to be coated because of the spring effect of the fold keeping it away therefrom. It will readily be understood that under such conditions it has not been possible to obtain uniform shrinkage between surface making contact with the object and surfaces which are not in contact therewith. The temperature thus varies over the periphery of the film depending on the zone in question, and this gives rise to different shrinkage percentages in spite of the fact that it is desirable for the shrinkage to be uniform. Some parts of the film will stop shrinking as soon as they make contact with the object, whereas other zones in the vicinity of the, or each, fold will shrink more than initially intended.

In an attempt at solving some of the difficulties outlined above, various means have been recommended, for example: using tunnels having multiple preheating-shrinking zones with flexible air-blowing tubes (European patent number 0 058 602), or forming re-entrant folds which make contact with the surface of an object around the perimeter of the sleeve to be shrunk. Mention may also be made of French patent number 75 30 896.

More recently, the Applicant has proposed blowing a gaseous fluid between the object and the loose sleeve to be shrunk on so as to inflate the sleeve and keep it out of contact with the object to be coated, with the temperature of the gaseous flow being chosen to be considerably lower than the softening temperature of the film constituting the sleeve, thereby making it possible to bring into equilibrium the temperatures of the inside and outside faces of the sleeve and to control the thermal gradient in the film in order to achieve film-object contact at a desired instant (see French patent number 85 15 717, in this respect).

This solution is advantageous, but it does not solve the problem of controlling the temperature in the tunnel in the zone occupied by the means for blowing in the gaseous fluid.

Such temperature control is crucial for effectively causing the sleeve to shrink with the inside and outside faces of the sleeve both being simultaneously at a predetermined same temperature, i.e. the temperature corresponding to the divide between the elastic region and the amorphous region for the film.

Such temperature control in tunnels is very difficult to achieve because of the numerous external disturbances which permanently alter the temperature level of the environment in the zone concerned by the blowing means.

It is easy to blow in a gaseous fluid at a constant temperature, however it is practically impossible to hold the temperature in a given zone of the tunnel steady, e.g. at a temperature corresponding to that selected for sleeve shrinking.

The external disturbances come from numerous sources.

Firstly, the inside of the tunnel is subjected along its length to convection currents which continuously displace temperature zones (due in particular to the temperature and number of objects passing along the tunnel and/or to air escaping from or into the tunnel). Mention should also be made of the thermal inertia of the shrinking system and the thermal inertia of the object conveyor system.

The state of the art is also illustrated by British patent number 1 062 349. This document describes a tunnel including hot air sources which are adjustable in height and/or along a transverse direction (this is however merely a prior adjustment performed as a function of the outside shape of the objects being conveyed, with the sources remaining in fixed positions in operation), together with a thermostat sensing the temperature of the air at the outlet from an external air-heater box containing resistance elements: such a tunnel contains no means for controlling temperature accurately.

Mention may be also be made of French patent number 2 233 234 which describes the use of a flow of hot air for smoothing a heat shrink capsule.

Finally, in the past, given the imperfect and random shrinking of a sleeve compared with the looked-for result, the use of heat shrink films in this application has been severely held back.

The object of the invention is to provide a method and apparatus for implementing the method for accurately controlling the temperature in a tunnel which is open at both ends, for the purpose of resolving the difficulties mentioned above.

Another object of the invention is to provide a method and an apparatus which are both simple and reliable, and in particular which enable perfectly uniform shrinkage to be obtained of a heat shrink sleeve without deforming printing thereon, and without wrinkling curling or puncturing it, regardless of the shape and size of the object to be decorated and/or protected.

Subsidiarily, in the context of the above-mentioned particular application, another object of the invention is to make it possible to make said controlled shrinking take place at mean temperatures on the surface of the film of about 100° C., for example, thereby avoiding many of the above-mentioned drawbacks of random shrinking performed at temperatures which may conventionally be as high as 180° C. to 250° C., thereby also reducing energy consumption and the length of tunnel required for shrinkage purposes.

More particularly, the present invention provides a method of controlling the temperature in a tunnel open at both ends and in which objects are displaced by the action of conveyor means, said tunnel including heating or cooling means disposed along its side walls and means for blowing in a gaseous fluid at a given temperature along a direction essentially perpendicular to the direction which the objects are conveyed, the method being characterized by the fact that it consists in detecting the temperature in the zone of the tunnel into which the gaseous fluid is blown, and in organizing the displacement of the blower means either in a direction counter to the direction in which the objects are being conveyed or in the direction the objects are being conveyed by means of a servo-control system ensuring that said blower means move automatically when the sensed temperature differs from a predetermined temperature, thereby permanently providing a constant temperature environment for the, or each, object in said zone of the tunnel.

Preferably, the temperature is sensed in said zone of the tunnel close to where the objects pass, as far as possible from the heater or cooler means, and as close as possible to the conveyor means. The servo-control is then particularly effective since the temperature is sense where disturbances are generally greatest.

Advantageously, the displacement of the blower means is organized in such a manner that its value varies linearly as a function of the detected difference between the sensed temperature and the predetermined temperature.

Preferably, the temperature is sensed by means of a temperature probe moving synchronously with the blower means; in particular, the temperature probe is prior positioned in such a manner that the sensed temperature corresponds to the predetermined temperature after which automatic displacement of the blower means is authorized from the corresponding initial position of said blower means.

In a particular application of the method, seeking to apply a length of heat shrink sleeve or covering onto an object, and in which the sleeve placed loosely over an object is heated so a to shrink onto said object, the predetermined temperature is selected to produce uniform shrinking of the sleeve after the sleeve has previously been inflated as the object surrounded by its sleeve penetrates into the zone of the tunnel into which said gaseous fluid is blown.

In particular, throughout their displacement, the blower means direct a flow of gaseous fluid over the object along a general flow direction which is substantially vertical.

Preferably, prior to reaching the zone of the tunnel into which the gaseous fluid is blown, the object surrounded by its sleeve is subjected to preheating solely by the heater means of said tunnel, thereby reaching a temperature which is very close to the shrinking point of the sleeve. Also preferably, after leaving the zone of the tunnel into which the gaseous fluid is blown, the object onto which the sleeve has been shrunk is subjected to heating by the heater means of said tunnel and by additional blower means in order to be raised for a short period of time to a high temperature which is considerably higher than the predetermined temperature, this corresponding to a finishing or smoothing stage.

The invention also provides apparatus for implementing the method, for fitting to a tunnel including means for conveying objects, heating or cooling means disposed along its side walls, and means for blowing a gaseous fluid at a given temperature towards said object, the apparatus being characterized by the fact that it includes a temperature sensor member disposed in the zone of the tunnel into which the gaseous fluid is blown, a carriage supporting the, or each, nozzle of the blower means, said carriage being movable in translation in a direction counter to the direction in which the objects are conveyed as well as in the direction the objects are conveyed, and motorized drive means for automatically displacing said carriage when the temperature sensed by said member differs from said predetermined temperature.

Preferably, the temperature sensor member is a temperature probe connected to a temperature regulator and fixed to the carriage supporting the, or each, nozzle of the blower means.

It is advantageous for the carriage supporting the, or each, nozzle of the blower means to move on rails provided at the top of the tunnel, with the, or each, nozzle passing through said carriage in order to direct a flow of gaseous fluid over the objects in a general flow direction which is substantially vertical; in particular, the, or each, nozzle is mounted on the carriage in such a manner as to enable its height to be adjusted in a direction which is essentially vertical.

In an embodiment which is particularly advantageous for simplicity and reliability, the motorized drive means are essentially constituted by a motor and gear box assembly, and a coupling member between said assembly and the carriage supporting the, or each, nozzle of the blower means. In particular, the motor and gear box assembly comprises an electric motor whose control is connected to the temperature probe via the associated temperature regulator, and a gear box whose outlet is provided with an endless screw co-operating with a nut fixed to the carriage.

It is then preferable for the motor and gear box assembly to be connected to the endless screw and to the temperature regulator of the temperature probe in such a manner that the displacement of the carriage varies linearly as a function of the temperature difference detected by said temperature probe, e.g. one millimeter per degree Celsius. It is then advantageous for the electric motor and the associated gear box to be mounted on a moving support capable of moving at the top of the tunnel; in particular, the moving support may include locking means enabling it to be locked in a determined position and/or the moving support may have two slideways serving as rails for the carriage.

Finally, it may be advantageous to provide for the carriage supporting the, or each, nozzle of the blower means also to support an additional blower member downstream from said nozzles in the object displacement direction, e.g. an extractor fan type of blower, and serving, optionally, to provide final additional heating of the objects.

The method of the invention may naturally be implemented in numerous different ways, however there follows a description of one particular embodiment of apparatus suitable for implementing the method, with reference to the figures of the accompanying drawings, in which:

FIG. 2 is a longitudinal section view through the FIG. 1 tunnel, showing the means for blowing in the gaseous fluid; and FIG. 3 is a plan view of the same tunnel, in which the gaseous fluid delivery ducts are omitted in order to distinguish the structure of the control apparatus of the invention more clearly.

Figure 1:
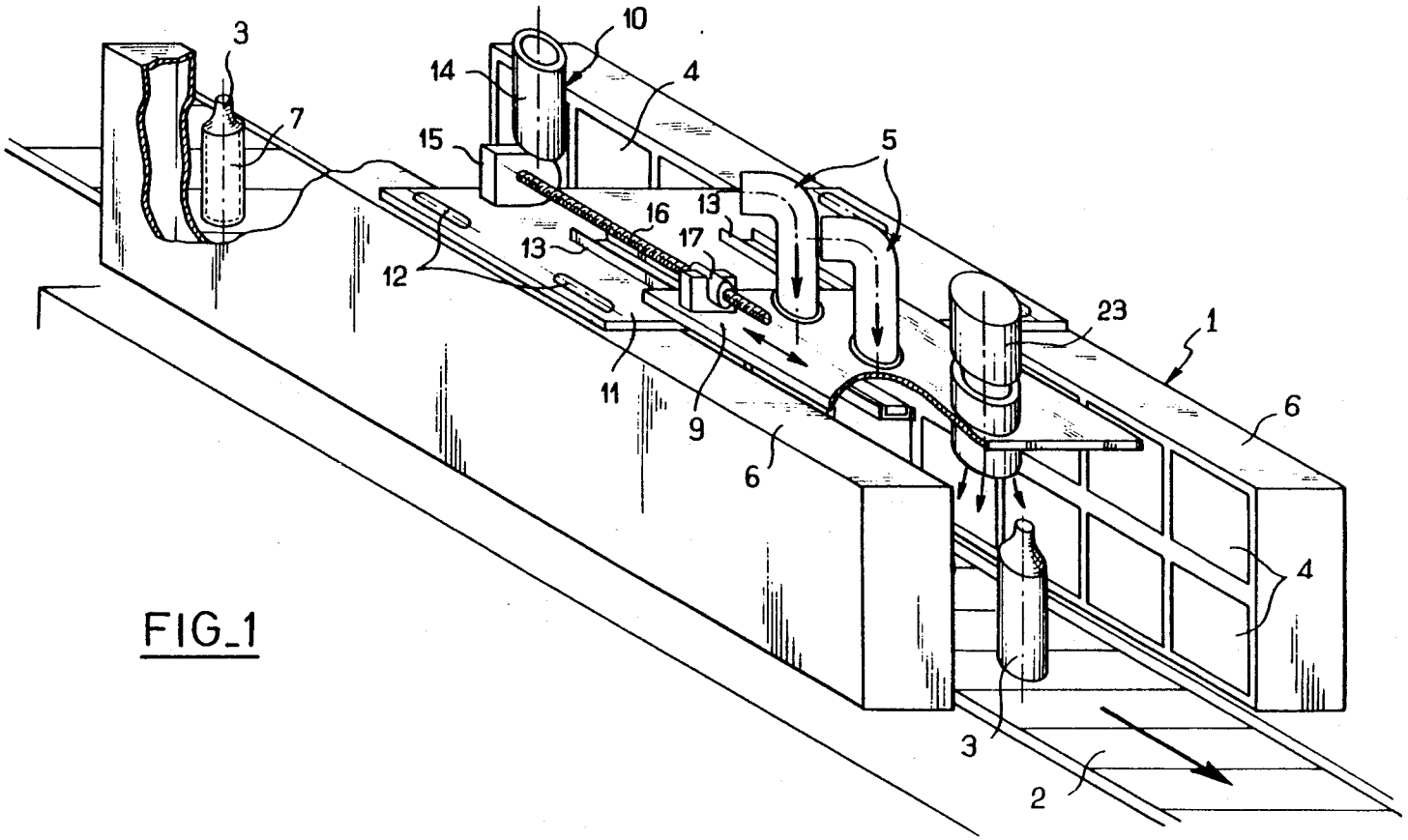
FIG. 1 is a diagrammatic perspective view of apparatus in accordance with the invention, with the means for blowing in the gaseous fluid being represented in this case by two nozzles mounted on a longitudinally displaceable moving carriage.

The temperature control apparatus of the invention is fitted, in this case, to a tunnel 1 including conveyor means 2 for conveying objects 3, heater means 4 disposed along its side walls, and means 5 for blowing a gaseous fluid at a given temperature towards said objects. If cooling is required, then the means 4 are replaced by any appropriate means, e.g. air blower means, for obtaining a temperature below ambient.

The above-mentioned means are conventional in tunnels and their structure is therefore recalled only briefly. The tunnel 1 comprises two side walls 6 in the form of boxes of length and height which are a function of the object on which a heat shrink sleeve is to be shrunk, and also of the desired throughput. The inside faces of each box 6 have a series of heater elements 4 disposed thereon, e.g. constituted by infrared radiant heaters. These heaters are distributed up the height of the objects concerned as one or more superposed elements. In conventional manner, the elements are connected to a temperature regulation device (not shown) which operates either with a single element or with a group of elements and with a temperature probe incorporated in the corresponding element or group of elements. This constitutes a simple embodiment of conventional regulation for the heater means of such tunnels. Naturally such infrared radiant heaters could be replaced by any equivalent means, and they may optionally be accompanied by flaps for distributing a flow of hot air. The conveyor means 2 are shown as being constituted, in this case, by an endless conveyor belt, but it would naturally be possible, in a variant, to use a chain provided with devices for holding objects and driven either continuously or stepwise while holding the objects in a fixed orientation or while rotating them about their own axes. Thus, the objects 3 to be coated travel on the endless conveyor 2 after a loose sleeve 7 has been placed around each object by a conventional machine, with said sleeve being put into place before the object enters the tunnel 1.

The blower means 5 serve to blow in a gaseous fluid, in particular air, and they are shown only in part in FIG. 1, being represented by the ends of one or more delivery ducts each connected to an associated blow nozzle. Such blower means are already used in the prior art; however in the prior art their longitudinal positions were fixed, or else they moved synchronously with the displacement of objects on the endless conveyor, so as to accompanying the objects while they pass along the tunnel.

In accordance with a fundamental aspect of the invention, a temperature sensor member 8 is provided in the zone of the tunnel concerned by the inward flow of gaseous fluid, a carriage 9 is provided supporting the, or each, nozzle of the blower means 5, said carriage being movable in translation in a counter direction to the direction in which the objects 3 are conveyed as well as in the direction the objects 3 are conveyed, and motor drive means 10 are provided for automatically displacing said carriage when the temperature sensed by said member 8 departs from a predetermined temperature.

In accordance with the above-mentioned fundamental principle, when the sensor member 8 detects a temperature in the hot chamber which is different from the temperature selected for shrinking, this information is conveyed to the motorized drive means 10 in such a manner as to cause the moving carriage 9 to move and position the carriage and thus also the blower means in the temperature range required for shrinking and as set on an associated temperature regulator (not shown). As a result, the instability of this zone due to external disturbances gives rise to continuous backwards and forwards movement of the moving carriage 9, and thus of the blow nozzles carried by the carriage, with this backwards and forwards movement preferably taking place about a position determined during initial adjustment of the shrinkage system.

It is thus easy to implement the essential characteristic of the method of the invention, whereby the temperature is sensed in the zone of the tunnel into which the gaseous fluid is being blown, and the displacement of the blower means is organized either in a direction counter to the direction in which the objects are being conveyed or in the direction the objects are being conveyed by servo-control which causes the blower means to move automatically when the detected temperature differs from the predetermined temperature, thereby permanently ensuring that the, or each, object concerned remains in a constant temperature environment in this zone of the tunnel.

The temperature sensing member is preferably in the form of a temperature probe 8 connected to a temperature regulator (not shown) and fixed to the carriage 9 supporting the, or each, nozzles of the blower means 5. The temperature is preferably sensed in the vicinity of the passage for the objects 3 at a point which is as far away as possible from the heater means 4 and as close as possible to the conveyor means 2. This imparts maximum effectiveness to the servo-control of the displacement of the blower means as a function of the temperature differences detected by the temperature probe. It may be advantageous to coat the temperature probe 8 with an insulating coating and to provide for its bottom end to be chamfered so as to have a sloping facette facing the hot surroundings, thereby better preserving the sensing end of the temperature probe relative to the heat flux delivered by the adjacent infrared radiant heaters.

The carriage 9 supporting the, or each nozzle of the blower means 5 moves on rails provided at the top of the tunnel 1, these rails may be placed on the tops of the side walls 6 of the tunnel, or else, as shown here, on the support of the motorized drive means 10. The motorized drive means 10 are mounted on a moving support 11 suitable for moving along the top of the tunnel 1 either in a counter direction to the direction in which objects are conveyed or in the direction the objects are conveyed and suitable for being locked in a predetermined position by associated locking means (the longitudinal slots 12 shown diagrammatically herein represent its freedom of movement prior to being locked in place by any appropriate means such as clamping bolts). The moving support 11 thus have two slideways 13 constituting the support rails of the carriage 9.

Naturally, the positions of the temperature probe 8 and of the nozzles of the blower means 5 relative to the support carriage 9 may be adjustable: it is particularly advantageous for the nozzles passing through the carriage 9 and serving to direct a flow of gaseous fluid over the objects along a flow direction which is generally vertical, to be mounted so as to be adjustable in height along an essentially vertical direction, thereby adjusting them to the heights of the objects concerned.

The motorized drive means 10 are preferably constituted by a motor and stepdown gear box assembly, together with a member for coupling said assembly and the carriage 9 which supports the, or each, nozzle of the blow means 5. In particular, the motor and gear box assembly may comprise an electric motor 14 whose control is connected to the temperature probe 8 via an associated temperature regulator, and a stepdown gear box 15 having an outlet provided with an endless screw 16 which co-operates with a nut 17 fixed to the carriage 9.

The connection of the motor and gear box assembly 14, 15 with the endless screw 16 and with the temperature regulator of the temperature probe 8 is preferably provided in such a manner as to ensure that the carriage 9 is displaced linearly as a function of the temperature difference detected by said temperature probe. In particular, in order to illustrate the accuracy made possible by apparatus of the invention, it is advantageous to provide for the carriage 9 to move through 1 mm per degree Celsius detected in the difference from the predetermined temperature. To do this, it is possible to use a small electric motor rotating at 860 revolutions per minute (rpm) and associated with a gear box providing a speed reduction of 1/100 whose outlet is connected to an endless screw having a pitch of 3 mm. The blower means 5 are thus adapted to deliver a gaseous fluid at a temperature which is predetermined with maximum accuracy.

With reference to FIGS. 2 and 3, an airtight box 18 which may be mounted on the outside face of one of the side boxes 6 of the tunnel or which may be located elsewhere, encloses a series of electrical resistance elements 19. At one of the ends of this box 18, there is a fan 20 which sucks in outside ambient air and which blows it over the electrical resistances 19 inside the box. The heated air is then delivered from the box via one or more orifices (two in this case) each connected to an associated corrugated metal hose 21 connected to an associated rigid nozzle 22 mounted on the carriage 9. By way of example, the airtight box may be about 2 meters long and its outlet orifices may be about 60 mm in diameter.

In either or both of the nozzles 22 there is a temperature probe (not shown) connected to a temperature regulator for obtaining air at the outlet from the nozzle at a desired temperature. In practice, the fan 20 must be capable of blowing air at a speed of about 6 meters per second (m/s) from the outlet from the nozzle. However, as shown in FIG. 2, it is possible to provide closure butterfly valves 25 at the delivery outlets 24 of the box 18 so as to vary at will the volume and the speed of the air at the outlet from the rigid nozzles 22.

When the method of the invention is applied to shrinking a heat shrink sleeve 7 onto an object 3, the predetermined temperature is naturally selected to produce uniform shrinking of the sleeve 7 after the sleeve has been inflated when the object fitted with its sleeve enters the zone of the tunnel into which said gaseous fluid is blown. The gaseous fluid blown in by the means 5 thus performs two functions: firstly it inflates the sleeve to keep it away from the object, and secondly it sweeps the corresponding hot zone on either side of the wall of said sleeve.

In practice, the temperature probe 8 is previously position in such a manner that the temperature it senses corresponds to the predetermined temperature, after which automatic displacement of the blower means 5 is authorized from a corresponding initial position of said blower means. The temperature probe 8 then remains situated in the zone where the optimum temperature for shrinking the sleeve obtains, which temperature is known from the characteristics of the plastic film being used, and is obtained by adjusting the various heater elements 4 by means of their associated temperature regulators. By virtue of the motor and gear box assembly being connected to the temperature probe via the associated temperature regulator, the motor and gear box assembly moves the rigid blower nozzles automatically in a forwards or backwards direction (relative to the direction in which the objects are conveyed) depending on whether the sensed temperature is less than or greater than the required temperature for shrinking as set on the regulator.

Advantageously, prior to entering the zone of the tunnel into which the gaseous fluid is blown, the object 3 together with its sleeve 7 is preheated by the heater means 4 of said tunnel on their own, in order to reach a temperature which is very close to the shrinking point of the sleeve 7. This temperature is regulated as before by means of temperature regulators associated with the heater elements. In practice, it is advantageous to adjust the temperature in the appropriate upstream zone of tunnel 1 so that it rises progressively in order to ensure that the sleeve 7 is raised to a temperature close to its softening point as it moves between the two walls of the tunnel. During this preliminary preheating stage, only the outside face of the film has its temperature raised. However, the conditions for proper shrinking are not yet available since the inside face of the film is still partially or totally in contact with the wall of the object. This state naturally changes when the object and its sleeve penetrate into the zone including the blower means.

It is also preferable, downstream from the zone of the tunnel into which the gaseous fluid is blown, for the object on which the sleeve 7 has shrunk to be heated by the heater means 4 of said tunnel and by additional blower means 23 so as to be raised for a short period of time to a high temperature, considerable higher than the predetermined temperature, thereby obtaining a finishing or smoothing stage. This makes it possible to finish off shrinking and to confer optimum tension to the film: in practice, this stage lasts for several tenths of a second up to a maximum of one second, and takes place at a temperature which is preferably 200° C. to 400° C. These operating conditions are essentially determined by the speed at which the object is travelling. The additional means 23 may be of the extractor fan type, for example, and may advantageously be mounted on the same carriage 9 as carries the nozzles of the blower means 5. It may also be advantageous to dispose a deflector 26 (visible only in FIG. 2) at the outlet from the extractor fan 23 so that the air it delivers does not disturb the zone concerned by the blower means 5.

The method of the invention and the apparatus for implementing said method thus make it possible to obtain perfectly uniform shrinkage of a heat shrink sleeve by constantly and accurately controlling the temperature in the corresponding zone of the tunnel.

This avoids any air being blown in at too high a temperature which could cause the shrinkage to be non-uniform by virtue of temperature differences between the inside and outside faces of the heat shrink sleeve, and which could cause the top of the sleeve to shrink before the bottom, thereby blocking off an air escape and hindering the shrinking of the bottom portion of the sleeve. This also ensures that no air is blown in at too low a temperature since that would have the effect of making sleeve shrinkage non-uniform and of shutting off the bottom portion of the sleeve by virtue of premature shrinkage of this bottom zone.

The blower means shown herein comprise two nozzles, but that is naturally only by way of example. However, by having two nozzles it is possible to maintain air pressure for a greater period of time over the objects. In a variant, it would also be possible to provide two separate heater boxes each connected to an associated nozzle, thereby making it possible to blow in air at different temperatures. However, in practice, the number of nozzles should not be very high since the length of the shrinkage zone remains relatively short by virtue of the narrowness of the corresponding range of temperatures.

The invention thus provides a particularly simple and effective solution to the problem of temperature uniformity in a zone of a tunnel which is open at both ends, and it avoids the effects of any external disturbance.

The invention is not limited to the embodiment described above, but on the contrary it covers any variant which may use equivalent means to reproduce the essential characteristics as specified in the claims.

I claim:

1. A method of controlling the temperature in a tunnel open at both ends and in which objects are displaced by the action of conveyor means, said tunnel including heating or cooling means disposed along its side walls and means for blowing in a gaseous fluid at a given temperature along a direction essentially perpendicular to the direction which the objects are conveyed, the method being characterized by detecting the temperature in the zone of the tunnel into which the gaseous fluid is blown, and organizing the displacement of the blower means either in a direction counter to the direction in which the objects are being conveyed or in the direction the objects are being conveyed by means of a servo-control system ensuring that said blower means move automatically when the sensed temperature differs from a predetermined temperature, thereby permanently providing a constant temperature environment for the, or each, object in said zone of the tunnel.

2. A method according to claim 1, characterized by the fact that the temperature is sensed in said zone of the tunnel close to where the objects pass, as far as possible from the heater or cooler means, and as close as possible to the conveyor means.

3. A method according to claim 1, characterized by the fact that the displacement of the blower means is organized in such a manner that its value varies linearly as a function of the detected difference between the sensed temperature and the predetermined temperature.

4. A method according to claim 1 characterized by the fact that the temperature is sensed by means of a temperature probe moving synchronously with the blower means.

5. A method according to claim 4, characterized by the fact that the temperature probe is prior positioned in such a manner that the sensed temperature corresponds to the predetermined temperature after which automatic displacement of the blower means is authorized from the corresponding initial position of said blower means.

6. A method according to claim 1 seeking to apply a length of heat shrink sleeve or covering onto an object, and in which the sleeve placed loosely over an object is heated so a to shrink onto said object, the method being characterized by the fact that the predetermined temperature is selected to produce uniform shrinking of the sleeve after the sleeve has previously been inflated as the object surrounded by its sleeve penetrates into the zone of the tunnel into which said gaseous fluid is blown.

7. A method according to claim 6, characterized by the fact that throughout their displacement, the blower means direct a flow of gaseous fluid over the object along a general flow direction which is substantially vertical.

8. A method according to claim 6, characterized by the fact that prior to reaching the zone of the tunnel into which the gaseous fluid is blown, the object surrounded by its sleeve is subjected to preheating solely by the heater means of said tunnel, thereby reaching a temperature which is very close to the shrinking point of the sleeve.

9. A method according to claim 1 characterized by the fact that after leaving the zone of the tunnel into which the gaseous fluid is blown, the object onto which the sleeve has been shrunk is subjected to heating by the heater means of said tunnel and by additional blower means in order to be raised for a short period of time to a high temperature which is considerably higher than the predetermined temperature, this corresponding to a finishing or smoothing stage.

10. Apparatus for implementing the method according to claim 1, for fitting to a tunnel including means for conveying objects, heating or cooling means disposed along its side walls, and means for blowing a gaseous fluid at a given temperature towards said object, the apparatus being characterized by the fact that it includes a temperature sensor member disposed in the zone of the tunnel into which the gaseous fluid is blown, a carriage supporting the, or each, nozzle of the blower means, said carriage being movable in translation in a direction counter to the direction in which the objects are conveyed as well as in the direction the objects are conveyed, and motorized drive means for automatically displacing said carriage when the temperature sensed by said member differs from said predetermined temperature.

11. Apparatus according to claim 10, characterized by the fact that the temperature sensor member is a temperature probe connected to a temperature regulator and fixed to the carriage supporting the, or each, nozzle of the blower means.

12. Apparatus according to claim 10, characterized by the fact that the carriage supporting the, or each, nozzle of the blower means moves on rails provided at the top of the tunnel, with the, or each, nozzle passing through said carriage in order to direct a flow of gaseous fluid over the objects in a general flow direction which is substantially vertical.

13. Apparatus according to claim 12, characterized by the fact that the, or each, nozzle is mounted on the carriage in such a manner as to enable its height to be adjusted in a direction which is essentially vertical.

14. Apparatus according to claim 10, characterized by the fact that the motorized drive means are essentially constituted by a motor and gear box assembly, and a coupling member between said assembly and the carriage supporting the, or each, nozzle of the blower means.

15. Apparatus according to claim 14, characterized by the fact that the motor and gear box assembly comprises an electric motor whose control is connected to the temperature probe via the associated temperature regulator, and a gear box whose outlet is provided with an endless screw co-operating with a nut fixed to the carriage.

16. Apparatus according to claim 15, characterized by the fact that the motor and gear box assembly is connected to the endless screw and to the temperature regulator of the temperature probe in such a manner that the displacement of the carriage varies linearly as a function of the temperature difference detected by said temperature probe, e.g. one millimeter per degree Celsius.

17. Apparatus according to claim 15, characterized by the fact that the electric motor and the associated gear box are mounted on a moving support capable of moving at the top of the tunnel.

18. Apparatus according to claim 17, characterized by the fact that the moving support includes locking means enabling it to be locked in a determined position.

19. Apparatus according to claim 17, characterized by the fact that the moving support has two slideways serving as rails for the carriage.

20. Apparatus according to claim 10, characterized by the fact that the carriage supporting the, or each, nozzle of the blower means also supports an additional blower member downstream from said nozzles in the object displacement direction, e.g. an extractor fan type of blower, and serving, optionally, to provide final additional heating of the objects.

* * * * *